US009659539B2

(12) United States Patent
Tseng et al.

(10) Patent No.: US 9,659,539 B2
(45) Date of Patent: May 23, 2017

(54) GATE DRIVER CIRCUIT, DISPLAY APPARATUS HAVING THE SAME, AND GATE DRIVING METHOD

(71) Applicant: Novatek Microelectronics Corp., Hsinchu (TW)

(72) Inventors: Po-Yu Tseng, Taoyuan (TW); Chieh-An Lin, Taipei (TW); Po-Hsiang Fang, Hsinchu (TW); Jhih-Siou Cheng, New Taipei (TW); Ju-Lin Huang, Hsinchu County (TW); Yi-Chuan Liu, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 77 days.

(21) Appl. No.: 14/687,931

(22) Filed: Apr. 16, 2015

(65) Prior Publication Data

US 2016/0307529 A1 Oct. 20, 2016

(51) Int. Cl.
*G09G 3/36* (2006.01)
*G09G 3/3258* (2016.01)

(52) U.S. Cl.
CPC ..... *G09G 3/3648* (2013.01); *G09G 3/3258* (2013.01); *G09G 2300/04* (2013.01); *G09G 2310/08* (2013.01)

(58) Field of Classification Search
CPC .. G09G 3/3648; G09G 3/3258; G09G 3/3266; G09G 3/3674; G09G 3/3677;
(Continued)

(56) References Cited

U.S. PATENT DOCUMENTS 8,542,224 B2 9/2013 Hsiao et al.
8,803,856 B2 * 8/2014 Yamazaki ..... G09G 3/344 345/107
(Continued)

FOREIGN PATENT DOCUMENTS

CN 103236244 8/2013
TW 200614136 5/2006
(Continued)

OTHER PUBLICATIONS

"Notice of Allowance of Taiwan Counterpart Application," issued on Apr. 28, 2016, p. 1-p. 3.

*Primary Examiner* — Tom Sheng
(74) *Attorney, Agent, or Firm* — Jianq Chyun IP Office

(57) ABSTRACT

A gate driver, a display apparatus having the same, and a gate driving method are provided. The display apparatus includes a plurality of pixels, a data driver circuit, and a gate driver circuit. The gate driver circuit includes M groups of gate channels. Each of the M groups of gate channels includes a control circuit and an output buffer. The control circuit receives a power supply voltage from a power supply circuit and generates a modulated supply voltage. The output buffer is connected to the control circuit, the output buffer is powered by the modulated supply voltage to output a gate signal to a gate line of the display panel, wherein a driving pulse of the gate signal is shaped during a charge period according to the modulated supply voltage, and the shape of the driving pulse of the gate signal is maintained during a pre-charge period.

15 Claims, 9 Drawing Sheets

(58) Field of Classification Search
CPC ..... G09G 2300/04; G09G 2300/0866; G09G 2310/08; G09G 2310/0251; G09G 2310/0267; G09G 2320/0223; G09G 2320/0233
See application file for complete search history.

(56) References Cited

U.S. PATENT DOCUMENTS 9,153,191 B2 * 10/2015 Ding ..... G09G 3/3677
2004/0056831 A1 * 3/2004 Takatori ..... G09G 3/3651 345/88
2004/0196248 A1 10/2004 Sekine
2005/0237294 A1 * 10/2005 Miyachi ..... G09G 3/3648 345/102
2008/0117200 A1 * 5/2008 Nakatsuka ..... G09G 3/3677 345/214
2008/0238854 A1 * 10/2008 Kimura ..... G09G 3/3648 345/98
2008/0303765 A1 * 12/2008 Nakatsuka ..... G09G 3/3648 345/87
2009/0243995 A1 * 10/2009 Kimura ..... G09G 3/342 345/102
2011/0102406 A1 * 5/2011 Wang ..... G09G 3/3677 345/211
2011/0316640 A1 * 12/2011 Chang ..... G09G 3/3677 332/116
2012/0105405 A1 * 5/2012 Hsiao ..... G06F 1/3265 345/208
2013/0107152 A1 * 5/2013 Okumura ..... G09G 3/3677 349/41
2015/0280700 A1 * 10/2015 Lai ..... G09G 3/3677 345/215

FOREIGN PATENT DOCUMENTS

TW 201140547 11/2011
TW 201218156 5/2012
TW 201606733 2/2016

* cited by examiner

GATE DRIVER CIRCUIT, DISPLAY APPARATUS HAVING THE SAME, AND GATE DRIVING METHOD

BACKGROUND OF THE INVENTION

Field of Invention

The invention relates to a gate driver circuit, a display apparatus having the gate driver circuit, and a gate driving method.

Description of Related Art

With rapid advancement in various display technologies, recent display devices have been developing toward high brightness, wide viewing angle, fast responding speed, high resolution, and large size full-color displays.

In a typical liquid crystal display, the gate driver circuit outputs gate signals to the scan lines, and the scan lines are connected to the gate terminals of each of the thin film transistors (TFTs) of the pixels in the display. A data driving circuit applies data voltages to the pixels, and the gate signals turn on the TFTs so that the data voltages on the data lines are stored in storage capacitors for the pixels to display an image corresponding to the data voltages. As the display panel has grown in size in recent years, the loads on the scan lines have become heavy. To compensate, some manufacturers have turned to power modulation techniques by modulating the power signals provided to the gate driver circuit, as well as pre-charge techniques such as increasing the pulse width of the gate signals. However, these techniques may decrease the output level of the gate signals and impact the display quality.

SUMMARY OF THE INVENTION

The invention provides a gate driving circuit, a display apparatus, and a gate driving method capable of maintaining a pre-charge effect and the write speed of data into the storage capacitors.

The invention provides a gate driving circuit, including M groups of gate channels, in which M is an integer greater than 1. Each of the M groups of gate channels includes a control circuit and an output buffer. The control circuit receives a power supply voltage from a power supply circuit and generates a modulated supply voltage. The output buffer is connected to the control circuit, and the output buffer is powered by the modulated supply voltage to output a gate signal to a gate line of the display panel. A driving pulse of the gate signal is shaped during a charge period according to the modulated supply voltage, and the shape of the driving pulse of the gate signal is maintained during a pre-charge period.

In one embodiment of the invention, the control circuits in the M groups of gate channels modulate the power supply voltage so that each of the driving pulses of the gate signals is maintained at a preset level during the pre-charge period.

In one embodiment of the invention, the control circuits in the M groups of gate channels are independent from each other, and each of the modulated supply voltages is generated independently by each of the control circuits in the M groups of gate channels.

In one embodiment of the invention, the length of the pre-charge period is adjusted according to the number of scan lines.

In one embodiment of the invention, the control circuits and the output buffers of each of the M groups of gate channels are manufactured on a same chip.

In one embodiment of the invention, the control circuits of each of the M groups of gate channels are integrated in the corresponding output buffers.

The invention provides a display apparatus including a plurality of pixels, a data driver circuit, and a gate driver circuit. The pixels receive data signals in response to gate signals and display an image corresponding to the data signals. The data driver circuit applies the data signals to the pixels. The gate driver circuit sequentially applies the gate signals to the pixels according to modulated supply voltages. The gate driver circuit includes M groups of gate channels, in which M is an integer greater than 1. Each of the M groups of gate channels includes a control circuit and an output buffer. The control circuit receives a power supply voltage from a power supply circuit and generates a modulated supply voltage. The output buffer is connected to the control circuit, and the output buffer is powered by the modulated supply voltage to output a gate signal to a gate line of the display panel. A driving pulse of the gate signal is shaped during a charge period according to the modulated supply voltage, and the shape of the driving pulse of the gate signal is maintained during a pre-charge period.

The invention provides a gate driving method for a display panel, including the following steps. A plurality of gate channels are divided into M groups, M being an integer greater than 1. For each of the M groups of gate channels, a power supply voltage is received from a power supply circuit and a modulated supply voltage is generated by a control circuit. For each of the M groups of gate channels, a gate signal is outputted to a gate line of the display panel by an output buffer powered by the modulated supply voltage, in which a driving pulse of the gate signal is shaped during a charge period according to the modulated supply voltage, and the shape of the driving pulse of the gate signal is maintained during a pre-charge period.

In summary, according to embodiments of the invention, by dividing the gate channels in the gate driver circuit and modulating the power supply voltage in the gate driver circuit, the gate driver circuit, the display apparatus, and the gate driving method in embodiments of the invention are capable of maintaining the pre-charge effect and the write speed of data into the storage capacitors.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
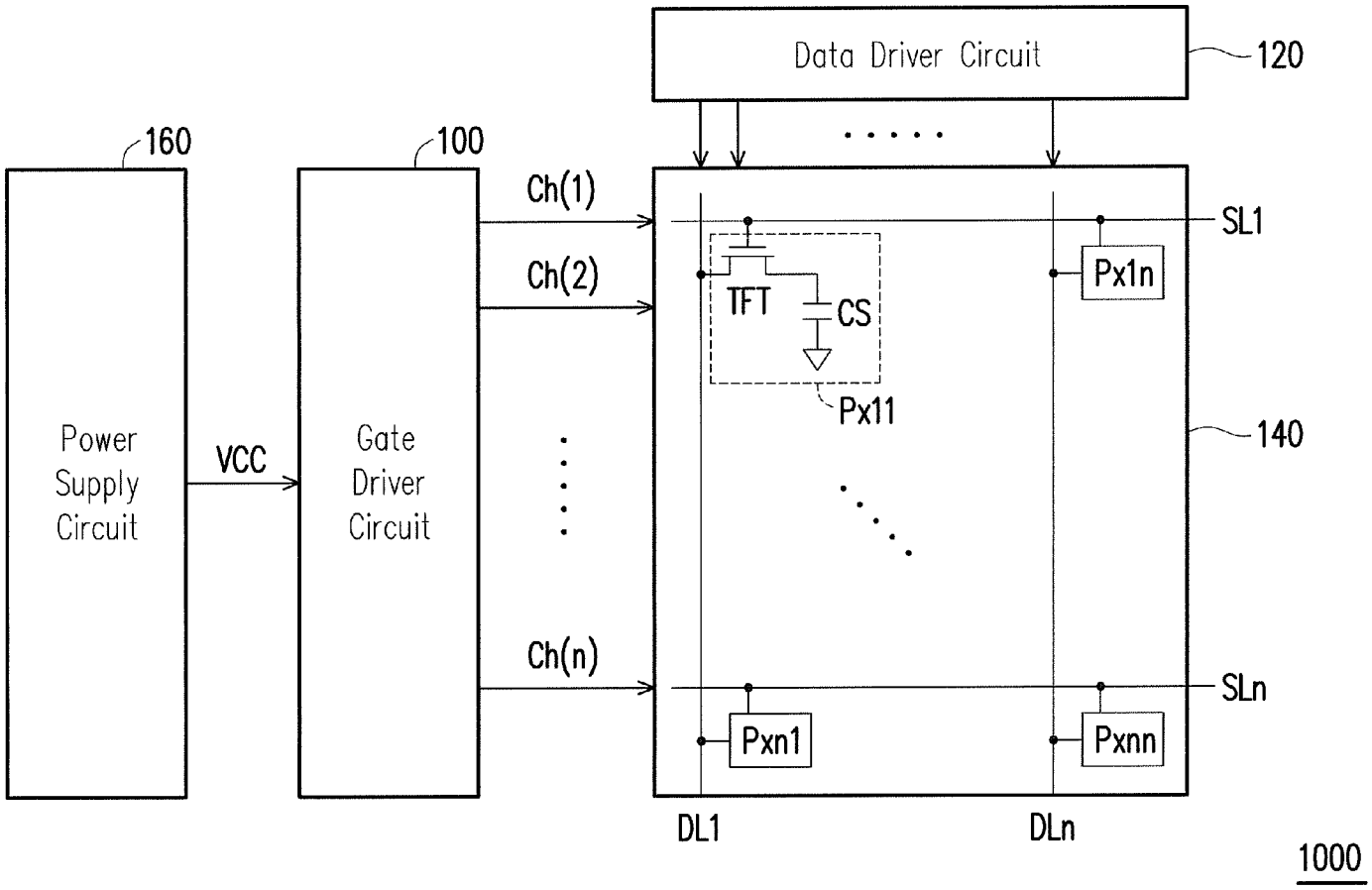
FIG. 1 is a schematic view of a display apparatus having a gate driver circuit according to an embodiment of the invention.

Reference will now be made in detail to the present preferred embodiments of the invention, examples of which are illustrated in the accompanying drawings.

Wherever possible, the same reference numbers are used in the drawings and the description to refer to the same or like parts.

FIG. 1 is a schematic view of a display apparatus having a gate driver circuit according to an embodiment of the invention. With reference to FIG. 1, a display apparatus 1000 includes a gate driver circuit 100, a data driver 120, a display panel 140, and a power supply circuit 160. The display panel 140 of the display apparatus 1000 may be a liquid crystal display panel, an organic light emitting display panel, or a display panel employing other suitable technologies, and the invention does not limit the type of display panel used in the display apparatus 1000. In the present embodiment, the display panel 140 includes a plurality of pixels Px11-Pxnn, a plurality of scan lines SL1-SLn, and a plurality of data lines DL1-DLn. The display panel 140 receives data signals in response to gate signals and displays an image corresponding to the data signals. The data driver circuit 120 applies the data signals to the pixels Px11-Pxnn. In the present embodiment, the gate driver circuit 100 may include a plurality of gate channels Ch(1)-Ch(n). The gate driver circuit 100 may receive a power supply voltage VCC and sequentially apply the gate signals to the pixels Px11-Pxnn according to gate control signals. Each of the pixels Px11-Pxnn includes a thin film transistor TFT and a storage capacitor CS, which is illustrated for the pixel Px11 in FIG. 1 for example. The gate signals sequentially provided by the gate driver circuit 100 may turn on the thin film transistor TFT and store the data on the data lines DL1-DLn for the image to be displayed by the display panel 140. It should be noted that, other components of the display apparatus 1000, such as a timing controller, are omitted in FIG. 1 for clarity of description.

Figure 2:
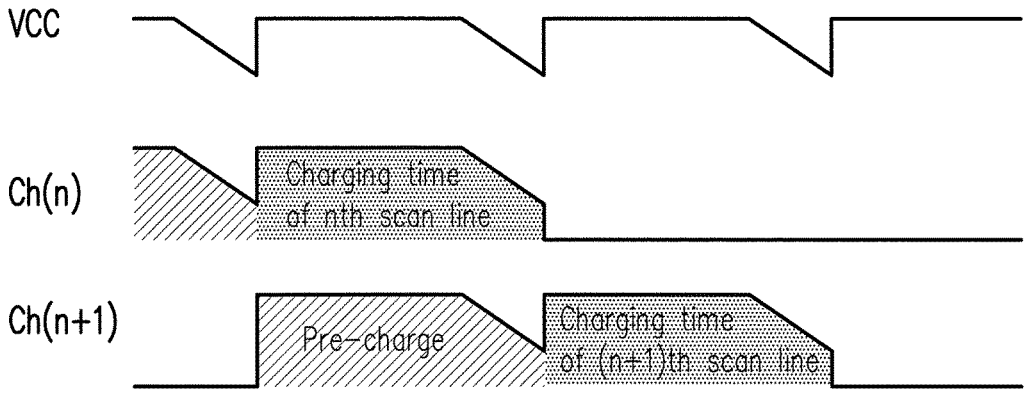
FIG. 2 is a timing diagram of power supply signals and gate signals when the power supply signals are modulated by a power supply circuit.

As the display panel 140 has grown in size in recent years, the loads on the scan lines SL1-SLn may require compensation to maintain display quality. The power supply voltage VCC may be modulated by the power supply circuit before being provided to the gate driver circuit 100, and the pulse width of the gate signals outputted by the gate channels Ch(1)-Ch(n) may be increased in a pre-charging technique of the storage capacitor CS by turning on the thin film transistor TFT in advance. FIG. 2 is a timing diagram of power supply signals and gate signals when the power supply voltage signals are modulated by the power supply circuit 160. With reference to FIG. 2, the waveform of the power supply voltage VCC is modulated by the power supply circuit 160 every time period. When the gate channel Ch(n+1) performs a pre-charge operation, due to the falling edge of the gate signal of the gate channel Ch(n) in response to the power supply voltage VCC modulated by the power supply circuit 160, the gate signal of the gate channel Ch(n+1) also has a falling edge during the pre-charge period. As a consequence, the equivalent resistance of the thin film transistors TFT increases and the pre-charge effect of the thin film transistors TFT degrades. In turns, the speed that data is written into the storage capacitors CS by the data lines DL1-DLn may be slowed down.

Figure 3:
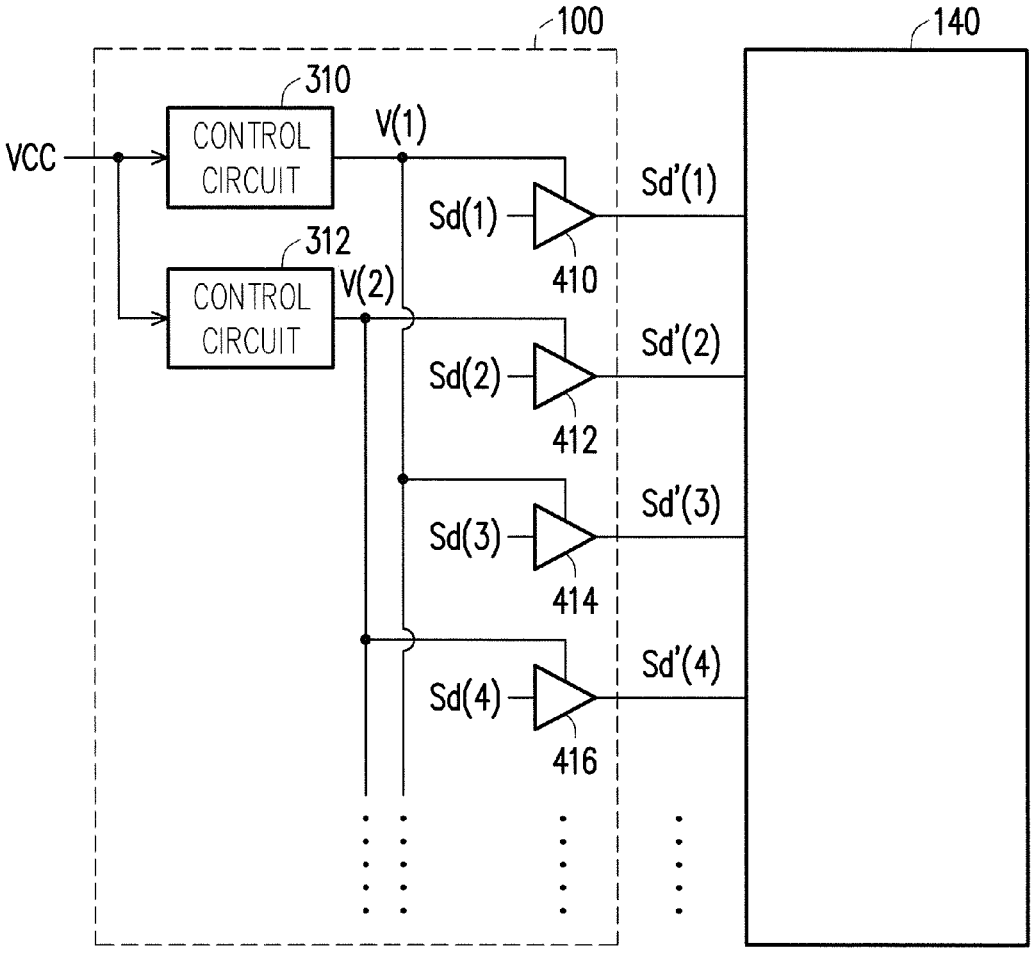
FIG. 3 is a schematic view of a gate driver circuit according to an embodiment of the invention.

Accordingly, in one embodiment of the invention, the power supply voltage is not modulated by the power supply circuit 160, but waveform modulation is performed independently by groups of control circuits in the gate driver circuit 100. FIG. 3 is a schematic view of a gate driver circuit according to an embodiment of the invention. With reference to FIG. 3, in the present embodiment, the gate driver circuit 100 includes M groups of gate channels, in which M is an integer greater than 1. In the example presented in FIG. 3, M is equaled to two since the gate channels are divided into two groups. Each of the two groups of gate channels includes a control circuit (e.g. 310, 312) receiving the power supply voltage VCC from the power supply circuit 160 and generating a modulated supply voltage (e.g. V(1), V(2)) by modulating the power supply voltage VCC. In the present embodiment, each of the two groups of gate channels further includes output buffers connected to the control circuits 310 or 312. For example, one of the two groups of gate channels includes output buffers 410 and 414 connected to the control circuits 310, and another one of the two groups of gate channels includes output buffers 412 and 416 connected to the control circuits 312. In each of the two groups of gate channels, the output buffers are powered by the modulated supply voltage (e.g. V(1), V(2)) to output a gate signal (e.g. Sd'(1), Sd'(2), Sd'(3), Sd'(4)) to a gate line (e.g. SL1 . . . SLn) of the display panel 140 in response to input signals (e.g. Sd(1), Sd(2), Sd(3), Sd(4)).

Figure 4:
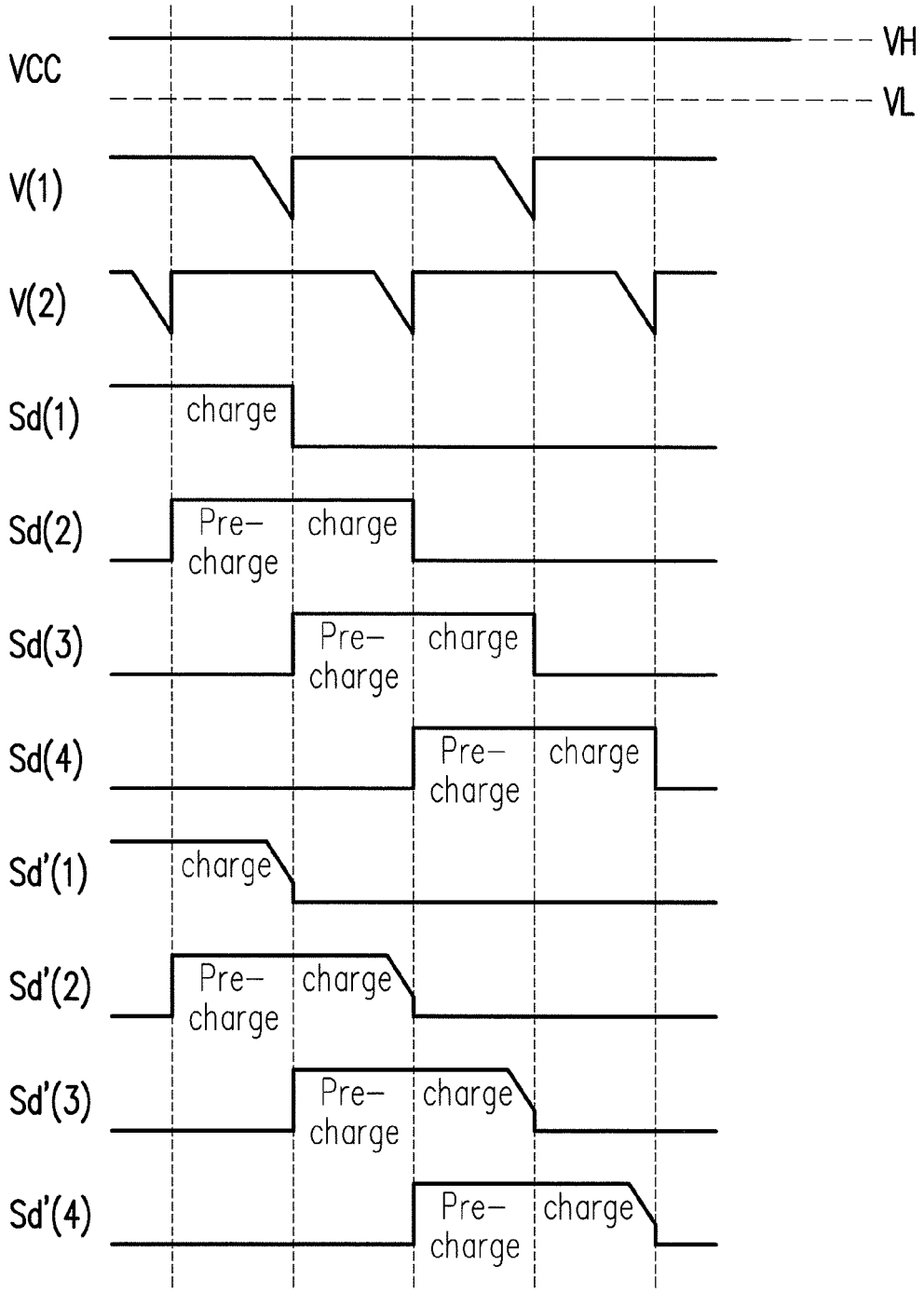
FIG. 4 is a timing diagram of the signals in the gate driver circuit depicted in FIG. 3.

FIG. 4 is a timing diagram of the signals in the gate driver circuit 100 depicted in FIG. 3. In the present embodiment, as shown in FIG. 4, a driving pulse of the gate signal (e.g. Sd'(1), Sd'(2), Sd'(3), Sd'(4)) is shaped during a charge period according to the modulated supply voltage (e.g. V(1), V(2)). In other words, the falling slope of the driving pulse of the gate signals Sd'(1), Sd'(2), Sd'(3), Sd'(4) are moderated. Moreover, the shape of the driving pulse of the gate signal is maintained during a pre-charge period. With reference to FIG. 3 and FIG. 4, in one embodiment of the invention, the control circuits 310 and 312 in the two groups of gate channels may modulate the power supply voltage VCC so that each of the driving pulses of the gate signals is maintained at a preset level during the pre-charge period. It should be appreciated that, in some embodiments, the length of the pre-charge period may adjusted according to the number of scan lines in the gate driver circuit 100.

In some embodiments of the invention, the control circuits 310 and 312 in the two groups of gate channels are independent from each other, and each of the modulated supply voltages V(1) and V(2) is generated independently by each of the control circuits 310 and 312 in the two groups of gate channels, as shown in FIG. 3. It should be noted that, in some embodiments of the invention, the control circuits 310 and 312 and the output buffers of each of the two groups of gate channels may be manufactured on a same chip. In other embodiments, it should also be noted that the control circuits 310 and 312 of each of the two groups of gate channels may be integrated in the corresponding output buffers 410, 412, 414, and 416. Furthermore, it should be noted that the gate driver circuit 100 may include other components not drawn in FIG. 3, such as logic circuits, level registers, and shift registers, which may be included according to an application of the gate driver circuit 100 and the display apparatus 1000.

Figure 5:
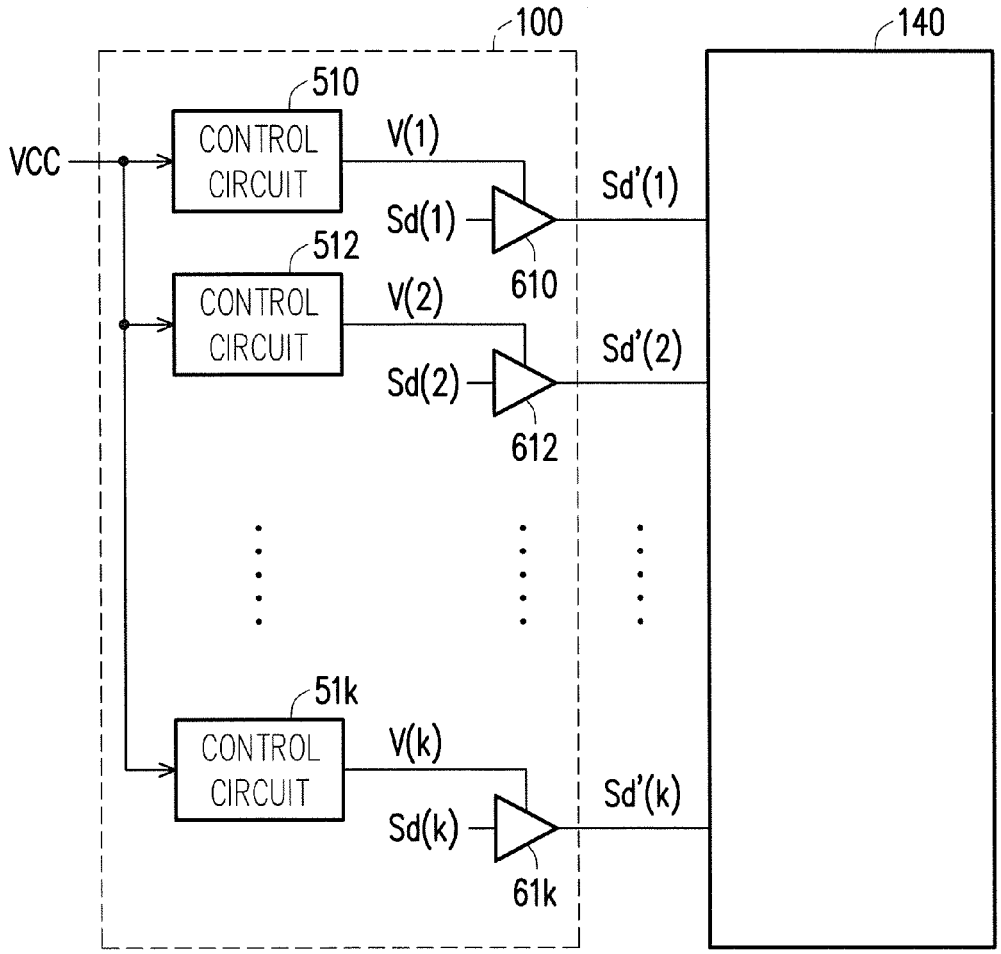
FIG. 5 is a schematic view of a gate driver circuit according to another embodiment of the invention.

It should be appreciated that the grouping of the gate channels is not limited to two groups. In the following example, the grouping of the gate channels is generalized for M=k groups. FIG. 5 is a schematic view of a gate driver circuit according to another embodiment of the invention. With reference to FIG. 5, in the present embodiment, the gate driver circuit 100 includes M groups of gate channels, in which M is an integer greater than 1. In the example presented in FIG. 5, M is equaled to k since the gate channels are divided into k groups. Each of the k groups of gate channels includes a control circuit (e.g. 510-51k) receiving the power supply voltage VCC from the power supply circuit 160 and generating a modulated supply voltage (e.g. V(1)-V(k)) by modulating the power supply voltage VCC. In the present embodiment, each of the k groups of gate channels further includes output buffers (e.g. 610-61k) connected to the control circuits 510-51k, for example. In each of the k groups of gate channels, the output buffers are powered by the modulated supply voltages (e.g. V(1)-V(k)) to output a gate signal (e.g. Sd'(1)-Sd'(k)) to a gate line (e.g. SL1 . . . SLn) of the display panel 140 in response to input signals (e.g. Sd(1)-Sd(k)).

Figure 6:
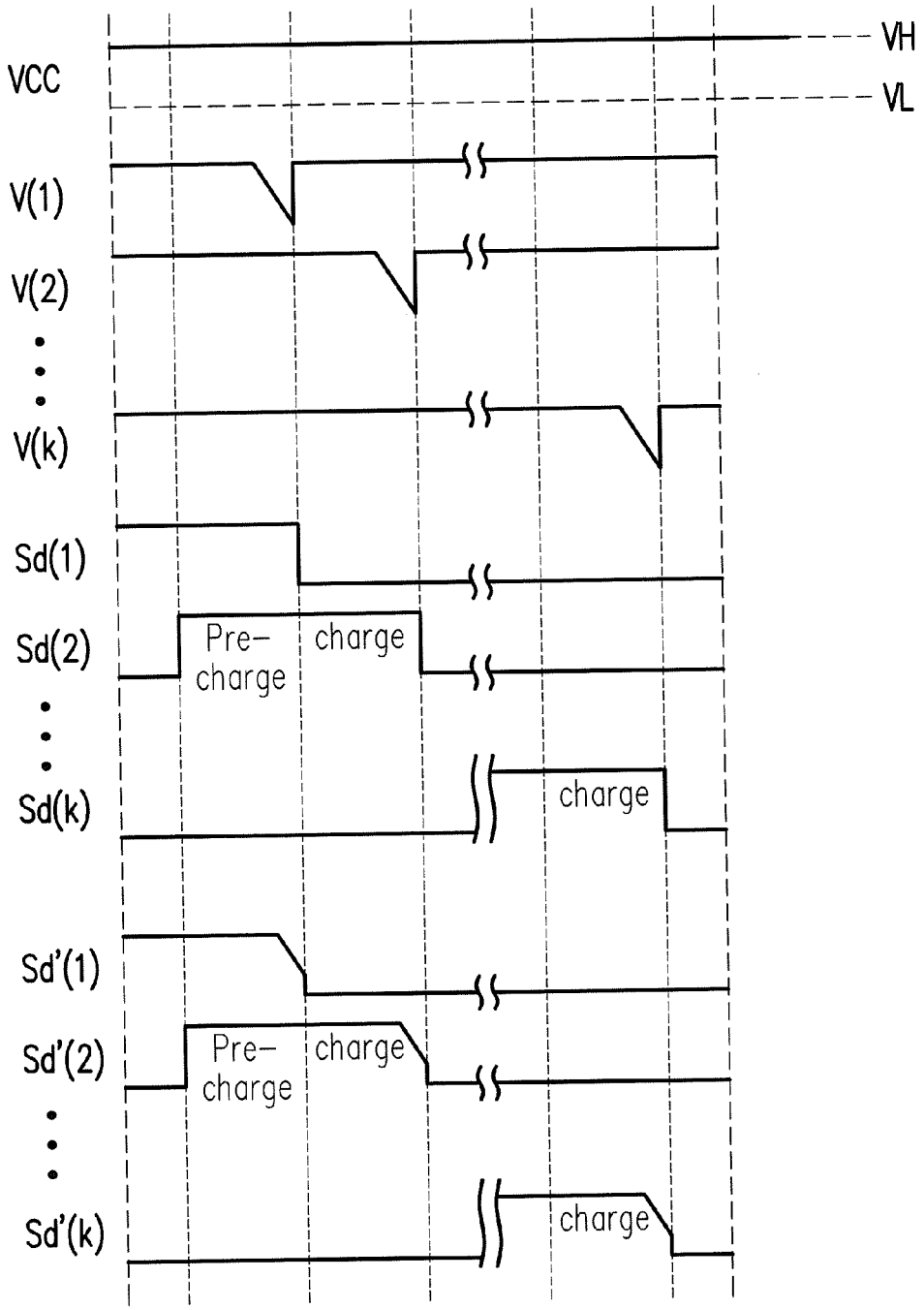
FIG. 6 is a timing diagram of the signals in the gate driver circuit depicted in FIG. 5.

FIG. 6 is a timing diagram of the signals in the gate driver circuit 100 depicted in FIG. 5. In the present embodiment, as shown in FIG. 5, a driving pulse of the gate signal (e.g. Sd'(1)-Sd'(k)) is shaped during a charge period according to the modulated supply voltage (e.g. V(1)-V(k)). Moreover, the shape of the driving pulse of the gate signal is maintained during a pre-charge period. With reference to FIG. 5 and FIG. 6, in one embodiment of the invention, the control circuits 510-51k in the k groups of gate channels may modulate the power supply voltage VCC so that each of the driving pulses of the gate signals is maintained at a preset level during the pre-charge period. Other features of the gate driver circuit of FIG. 5 has been described earlier for the gate driver circuit of FIG. 3, and therefore further elaboration thereof is omitted.

Figure 7:
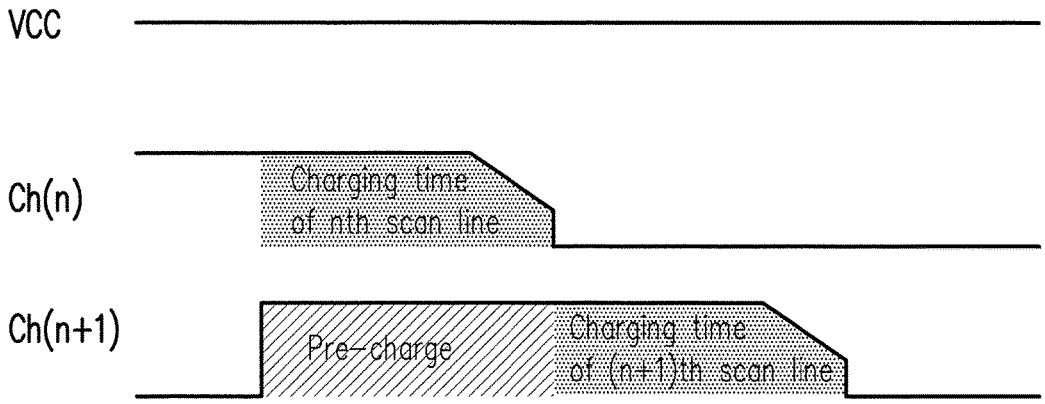
FIG. 7 is a signal diagram of a power supply voltage and gate channel output signals when the power supply voltage is modulated by the gate driver circuit depicted in FIG. 3.
Figure 8:
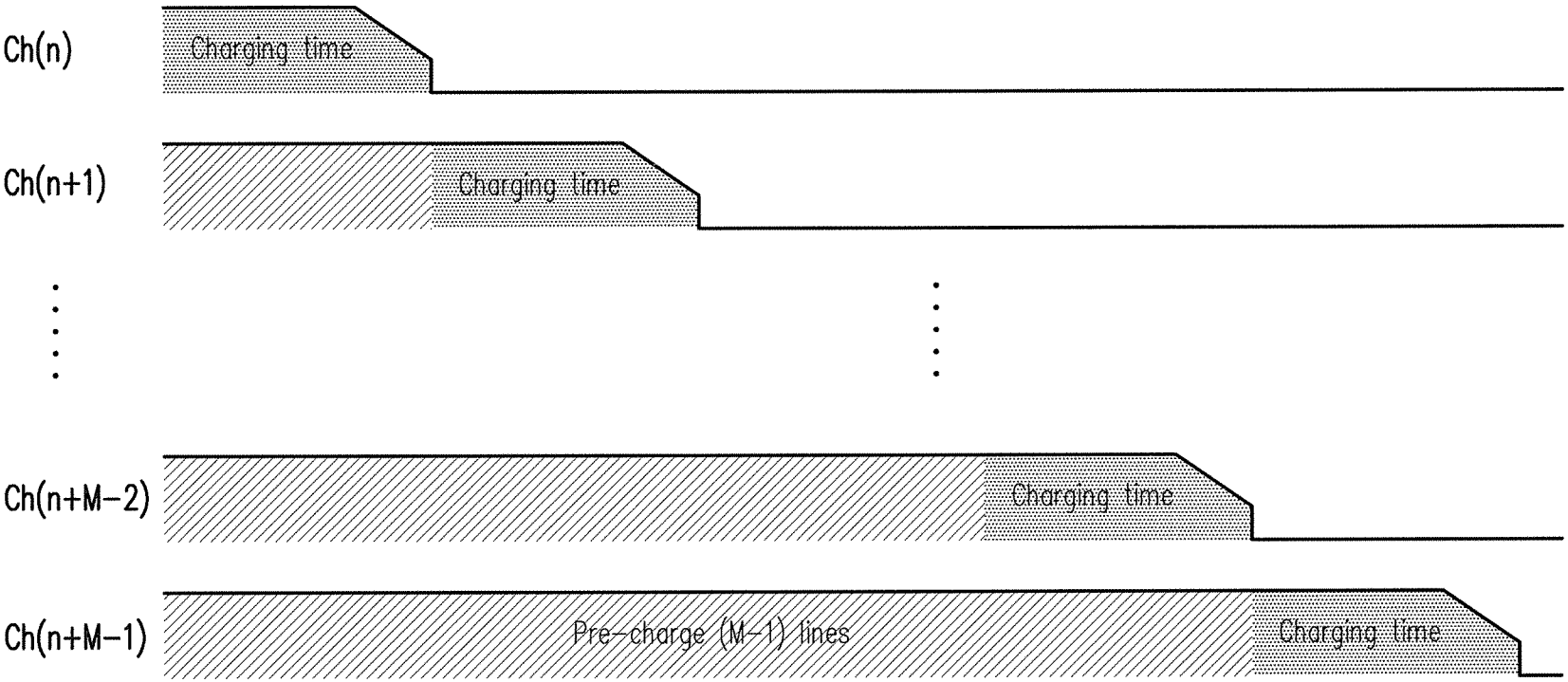
FIG. 8 is a signal diagram of gate channel output signals when the power supply voltage is modulated by the gate driver circuit depicted in FIG. 5.

To better illustrate the operation of the gate driving circuit 100 and how the length of the pre-charge period may be adjusted, FIG. 7 is a signal diagram of the power supply voltage VCC and gate channel output signals (e.g. Sd'(1)-Sd'(4)) when the power supply voltage VCC is modulated by the gate driver circuit depicted in FIG. 3, and FIG. 8 is a signal diagram of gate channel output signals (e.g. Sd'(1)-Sd'(k)) when the power supply voltage VCC is modulated by the gate driver circuit depicted in FIG. 5. With reference to FIG. 7, the power supply voltage VCC is not modulated by the power supply circuit 160, and by dividing the gate channels into M groups (e.g. M=2), in which each group has an independent waveform modulation circuit (e.g. control circuits 310-312) and the waveform modulation mechanism is embedded in the gate driver circuit 160, the pre-charge voltage level outputted by the gate channel Ch(n+1) does not drop off as in FIG. 2. The signal diagram of FIG. 8 for M=k groups of gate channels may be similarly deduced from FIG. 7. FIG. 8 depicts the gate signals outputted by gate channels Ch(n), Ch(n+1), Ch(n+M−2), and Ch(n+M−1) when controlled by the modulated supply voltages V(1)-V(k) shown in FIG. 5. In FIG. 8, by dividing the gate channels into M=k groups, the pre-charge voltage level outputted by the gate channels do not drop off as in FIG. 2, and the gate signals maintain the predetermined high level. That is, as shown in FIG. 7 and FIG. 8, the shape of the driving pulses of the gate signals is maintained during the pre-charge period, and the driving pulses of the gate signals are shaped during the charge period according to the modulated supply voltages.

In addition, the pre-charge period of the gate signals may be determined according to a total charging period of M−1 scan lines. That is, the length of the pre-charge period may be adjusted according to the number of scan lines.

Figure 9:
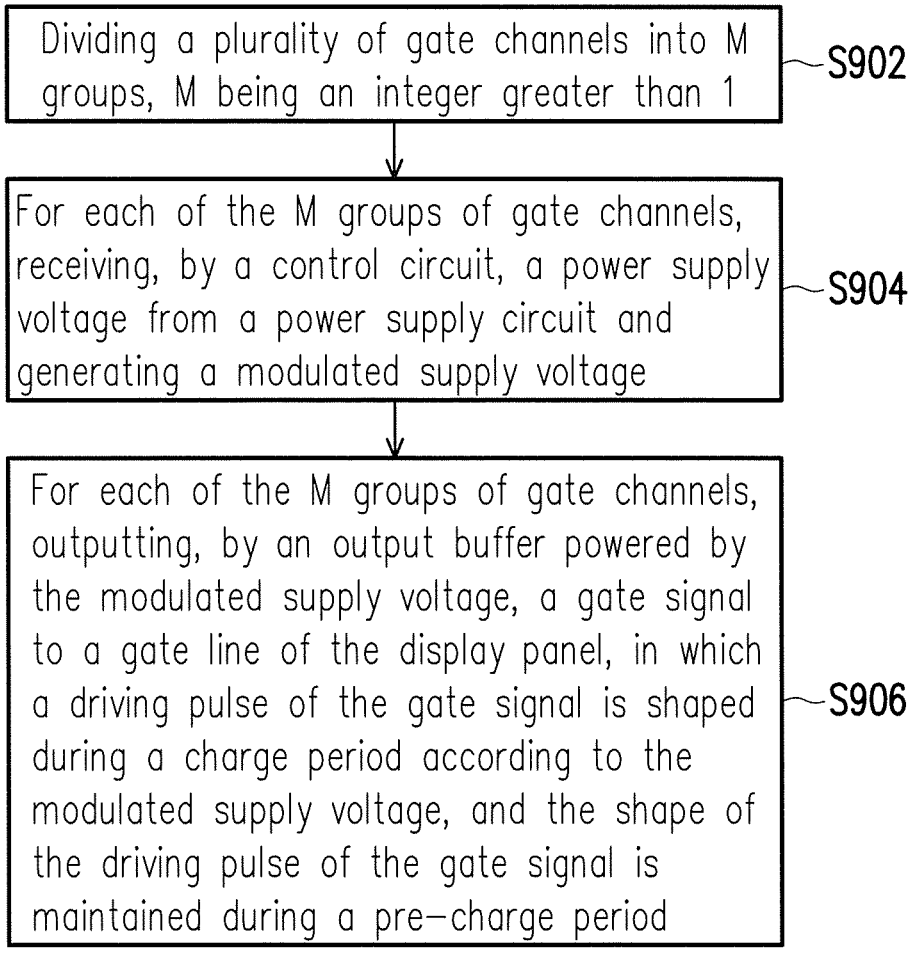
FIG. 9 is a flow diagram of a gate driving method for a display panel according to an embodiment of the invention.

In light of the above disclosure, a gate driving method for the display panel 140 may be obtained. FIG. 9 is a flow diagram of a gate driving method for a display panel according to an embodiment of the invention. In Step S902, a plurality of gate channels are divided into M groups, M being an integer greater than 1. In Step S904, for each of the M groups of gate channels, a power supply voltage is received from a power supply circuit and a modulated supply voltage is generated by a control circuit. In Step S906, for each of the M groups of gate channels, a gate signal is outputted to a gate line of the display panel by an output buffer powered by the modulated supply voltage, in which a driving pulse of the gate signal is shaped during a charge period according to the modulated supply voltage, and the shape of the driving pulse of the gate signal is maintained during a pre-charge period.

In one embodiment of the invention, the power supply voltage is modulated by the control circuits in the M groups of gate channels so that each of the driving pulses of the gate signals is maintained at a preset level during the pre-charge period.

In one embodiment of the invention, the control circuits in the M groups of gate channels are independent from each other, and each of the modulated supply voltages is generated independently by each of the control circuits in the M groups of gate channels.

In one embodiment of the invention, the length of the pre-charge period is adjusted according to the number of scan lines.

In one embodiment of the invention, the control circuits and the output buffers of each of the M groups of gate channels are manufactured on a same chip.

In one embodiment of the invention, the control circuits of each of the M groups of gate channels are integrated in the corresponding output buffers.

In view of the foregoing, according to embodiments of the invention, by dividing the gate channels in the gate driver circuit and modulating the power supply voltage in the gate driver circuit, the gate driver circuit, the display apparatus, and the gate driving method in embodiments of the invention are capable of maintaining the pre-charge effect and the write speed of data into the storage capacitors.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A gate driver circuit for driving a display panel, comprising:

M groups of gate channels, M being an integer greater than 1, wherein each of the M groups of gate channels comprises:

a control circuit receiving a power supply voltage from a power supply circuit and generating a modulated supply voltage; and an output buffer connected to the control circuit, the output buffer powered by the modulated supply voltage and receiving an input signal, so as to output a gate signal to a gate line of the display panel, wherein a driving pulse of the gate signal is shaped during a charge period according to the modulated supply voltage, and the shape of the driving pulse of the gate signal is maintained at a preset level during a pre-charge period, wherein the length of the pre-charge period is adjusted according to the number of scan lines.

2. The gate driver circuit according to claim 1, wherein the control circuits in the M groups of gate channels modulate the power supply voltage so that each of the driving pulses of the gate signals is maintained at the preset level during the pre-charge period.

3. The gate driver circuit according to claim 1, wherein the control circuits in the M groups of gate channels are independent from each other, and each of the modulated supply voltages is generated independently by each of the control circuits in the M groups of gate channels.

4. The gate driver circuit according to claim 1, wherein the control circuits and the output buffers of each of the M groups of gate channels are manufactured on a same chip.

5. The gate driver circuit according to claim 1, wherein the control circuits of each of the M groups of gate channels are integrated in the corresponding output buffers.

6. A display apparatus, comprising:

a plurality of pixels receiving data signals in response to gate signals and displaying an image corresponding to the data signals;

a data driver circuit applying the data signals to the pixels; and a gate driver circuit sequentially applying the gate signals to the pixels according to modulated supply voltages, the gate driver circuit comprising:

M groups of gate channels, M being an integer greater than 1, wherein each of the M groups of gate channels comprises:

a control circuit receiving a power supply voltage from a power supply circuit and generating a modulated supply voltage; and an output buffer connected to the control circuit, the output buffer powered by the modulated supply voltage and receiving an input signal, so as to output a gate signal to a gate line of the display panel, wherein a driving pulse of the gate signal is shaped during a charge period according to the modulated supply voltage, and the shape of the driving pulse of the gate signal is maintained at a preset level during a pre-charge period, wherein the length of the pre-charge period is adjusted according to the number of scan lines.

7. The display apparatus according to claim 6, wherein the control circuits in the M groups of gate channels modulate the power supply voltage so that each of the driving pulses of the gate signals is maintained at the preset level during the pre-charge period.

8. The display apparatus according to claim 6, wherein the control circuits in the M groups of gate channels are independent from each other, and each of the modulated supply voltages is generated independently by each of the control circuits in the M groups of gate channels.

9. The display apparatus according to claim 6, wherein the control circuits and the output buffers of each of the M groups of gate channels are manufactured on a same chip.

10. The display apparatus circuit according to claim 6, wherein the control circuits of each of the M groups of gate channels are integrated in the corresponding output buffers.

11. A gate driving method for a display panel, the gate driving method comprising:

dividing a plurality of gate channels into M groups, M being an integer greater than 1;

for each of the M groups of gate channels:

receiving, by a control circuit, a power supply voltage from a power supply circuit and generating a modulated supply voltage; and outputting, by an output buffer powered by the modulated supply voltage, a gate signal to a gate line of the display panel according to an input signal and the modulated supply voltage, wherein a driving pulse of the gate signal is shaped during a charge period according to the modulated supply voltage, and the shape of the driving pulse of the gate signal is maintained at a preset level during a pre-charge period, wherein the length of the pre-charge period is adjusted according to the number of scan lines.

12. The gate driving method according to claim 11, wherein the power supply voltage is modulated by the control circuits in the M groups of gate channels so that each of the driving pulses of the gate signals is maintained at the preset level during the pre-charge period.

13. The gate driving method according to claim 11, wherein the control circuits in the M groups of gate channels are independent from each other, and each of the modulated supply voltages is generated independently by each of the control circuits in the M groups of gate channels.

14. The gate driving method according to claim 11, wherein the control circuits and the output buffers of each of the M groups of gate channels are manufactured on a same chip.

15. The gate driving method according to claim 11, wherein the control circuits of each of the M groups of gate channels are integrated in the corresponding output buffers.

* * * * *